US009390874B2

(12) United States Patent
Meftah et al.

(10) Patent No.: US 9,390,874 B2
(45) Date of Patent: Jul. 12, 2016

(54) DEVICE FOR DETECTING AND SIGNALING A CHANGE IN THE STATE OF A PUSH BUTTON

(75) Inventors: Tewfik Meftah, Grenoble (FR); Alain Guillot, Fleac (FR); Dominique Benni, Mornac (FR); Bernard Desaphie, Saint Yrieix (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 486 days.

(21) Appl. No.: 13/816,289

(22) PCT Filed: Aug. 1, 2011

(86) PCT No.: PCT/EP2011/063185

§ 371 (c)(1),
(2), (4) Date: Feb. 11, 2013

(87) PCT Pub. No.: WO2012/025335

PCT Pub. Date: Mar. 1, 2012

(65) Prior Publication Data

US 2013/0134798 A1 May 30, 2013

(30) Foreign Application Priority Data

Aug. 25, 2010 (FR) ..... 10 56741

(51) Int. Cl.
*H01H 50/08* (2006.01)
*H01H 13/02* (2006.01)
(Continued)

(52) U.S. Cl.
CPC ..... *H01H 50/08* (2013.01); *H01H 3/022* (2013.01); *H01H 9/168* (2013.01); *H01H 13/02* (2013.01); *H01H 2003/024* (2013.01)

(58) Field of Classification Search
CPC ..... H01H 50/08
USPC ..... 307/103; 200/341; 340/5.61, 6.1, 7.24
See application file for complete search history.

(56) References Cited

U.S. PATENT DOCUMENTS 2,877,817 A * 3/1959 Rockwell ..... F16B 37/122 411/106
3,523,169 A * 8/1970 Di Pilla ..... H01H 9/162 200/314

(Continued)

FOREIGN PATENT DOCUMENTS

DE 10 2007 024 296 11/2008
EP 1 152 441 11/2001

(Continued)

OTHER PUBLICATIONS

International Search Report Issued Oct. 20, 2011 in PCT/EP11/63185 Filed Aug. 1, 2011.

*Primary Examiner* — Rexford Barnie
*Assistant Examiner* — Thai Tran
(74) *Attorney, Agent, or Firm* — Oblon, McClelland, Maier & Neustadt, L.L.P.

(57) ABSTRACT

A device for detecting and signalling a change of state of a push-button, for example of emergency stop type. The device is in a form of an attachment that can be removed from the push-button and includes: an electrical energy generator housed in a casing of the device and configured to cooperate with a control head of the push-button to convert mechanical energy into electrical energy; and a wireless transmitter to send a message to a remote receiver, the wireless transmitter being housed in the casing and electrically connected to the electrical energy generator.

14 Claims, 5 Drawing Sheets

Figure 1:
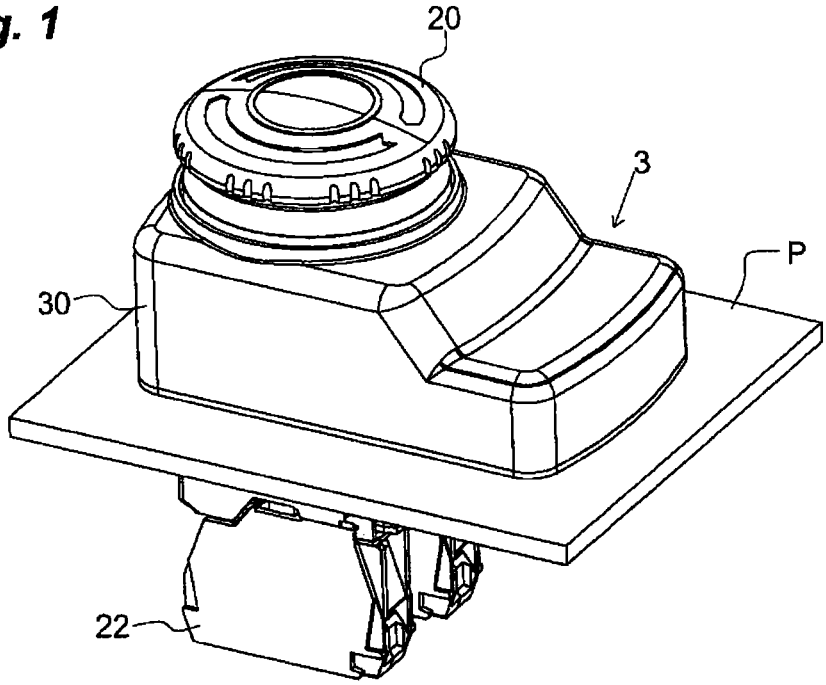

(51) Int. Cl.
*H01H 3/02* (2006.01)
*H01H 9/16* (2006.01)

(56) References Cited

U.S. PATENT DOCUMENTS 6,842,123 B1 1/2005 Fujita et al.
2002/0070635 A1* 6/2002 Morrison et al. ..... 310/311
2002/0074898 A1* 6/2002 Maue et al. ..... 310/311
2003/0016136 A1 1/2003 Harvey
2004/0119599 A1* 6/2004 Stevenson ..... B60R 22/48 340/686.1
2004/0124741 A1* 7/2004 Morrison et al. ..... 310/314
2005/0061568 A1* 3/2005 Schondorf ..... B60R 22/48 180/268
2006/0219479 A1* 10/2006 Petzl et al. ..... 182/3
2009/0014306 A1* 1/2009 Swamy ..... H01H 3/022 200/530
2011/0063057 A1* 3/2011 Takahashi ..... H02K 35/02 335/207

FOREIGN PATENT DOCUMENTS

WO 03 009419 1/2003
WO WO 2010055045 A1 * 5/2010 ..... H01H 5/02

* cited by examiner

DEVICE FOR DETECTING AND SIGNALING A CHANGE IN THE STATE OF A PUSH BUTTON

The present invention relates to a device for detecting and signalling the change of state of a push-button and to a control assembly combining the push-button and the detection and signalling device. The detection and signalling device of the invention is in particular entirely suitable for use on a push-button of the emergency stop type.

In certain controlled processes, it is known to put a plurality of emergency stops in series in order to safeguard the process over its entire length. Actuation of one of the emergency stops allows the process to be stopped. When the number of emergency stops in series is very large, however, is often difficult to know which of the emergency stop has been activated.

The object of the invention is therefore to provide a device for detecting the change of state of a push-button, for example an emergency stop, and for signalling this change of state, this device being easy to assemble on an existing push-button without altering the structure of the latter.

This object is achieved by a device for detecting and signalling the change of state of a push-button, the said push-button comprising a body, and a control head mounted on the body and actuable in translation along a principal axis between a plurality of positions so as to impart different states to the push-button in order to control an electrical circuit, the device being in the form of an attachment which can be removed from the push-button and comprising:

- a casing through which an opening is formed, the body of the push-button being intended to pass through this opening,
- an electrical energy generator housed in the casing and adapted to cooperate with the control head in order to convert mechanical energy into electrical energy,
- a wireless transmitter for sending a message to a remote receiver, the said wireless transmitter being housed in the casing and electrically connected to the electrical energy generator.

According to one feature, the electrical energy generator is of the electromagnetic type and comprises a magnetic circuit provided with a fixed part and a mobile part and an electromagnetic coil through which the magnetic circuit passes.

According to another feature, the device comprises a connecting piece cooperating with the electrical energy generator and actuable in translation by the control head.

According to another feature, the connecting piece comprises a ring mounted on restoring means, coaxially with respect to the opening.

According to another feature, the device comprises a spring mounted between the connecting piece and the mobile part of the electrical energy generator.

According to another feature, the connecting piece comprises a tab integral with the ring, the said tab having an oblong opening through which a lug formed on the mobile part passes.

According to another feature, the mobile part of the electrical energy generator can move between a first position and a second position, and the energy generator is arranged in order to generate a first amount of energy when the mobile part passes from the first position to the second position and a second amount of energy when the mobile part passes from the second position to the first position.

According to another feature, the device comprises an electronics board housed in the casing and comprising the wireless transmitter, the said wireless transmitter being electrically connected to the electrical energy generator.

According to another feature, the transmitter is a radiofrequency transmitter.

According to another feature, the transmitter is of the infrared type.

The invention also relates to a control assembly comprising a push-button provided with a body, and a control head mounted on the body and actuable in translation along a principal axis between a plurality of positions so as to impart different states to the push-button, characterized in that the control assembly also comprises a device for detecting and signalling the change of state of the push-button as defined above, the said device being fitted around the push-button and arranged to cooperate mechanically with the control head.

According to the invention, the wireless transmitter is arranged to send a first message when the control head of the push-button is depressed and a second message when the control head (20) of the push-button is released.

According to one feature:

- the control assembly comprises a contact unit assembled on the body of the push-button and adapted to be actuated by the control head,
- the body of the push-button is mounted in an orifice formed through a wall, the control head being located on the front side with respect to the wall and the contact unit on the rear side with respect to the wall,
- the device for detecting the change of state of the push-button is mounted on the front side with respect to the wall and arranged between the control head and the wall.

The inventions detailed above are particularly suited to be used for a push-button of the emergency stop type.

Figure 2:
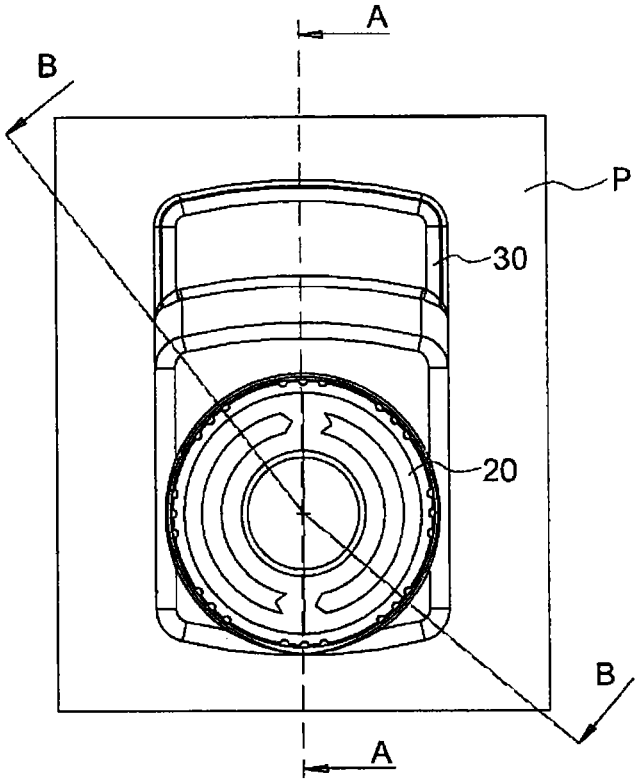
Figure 3:
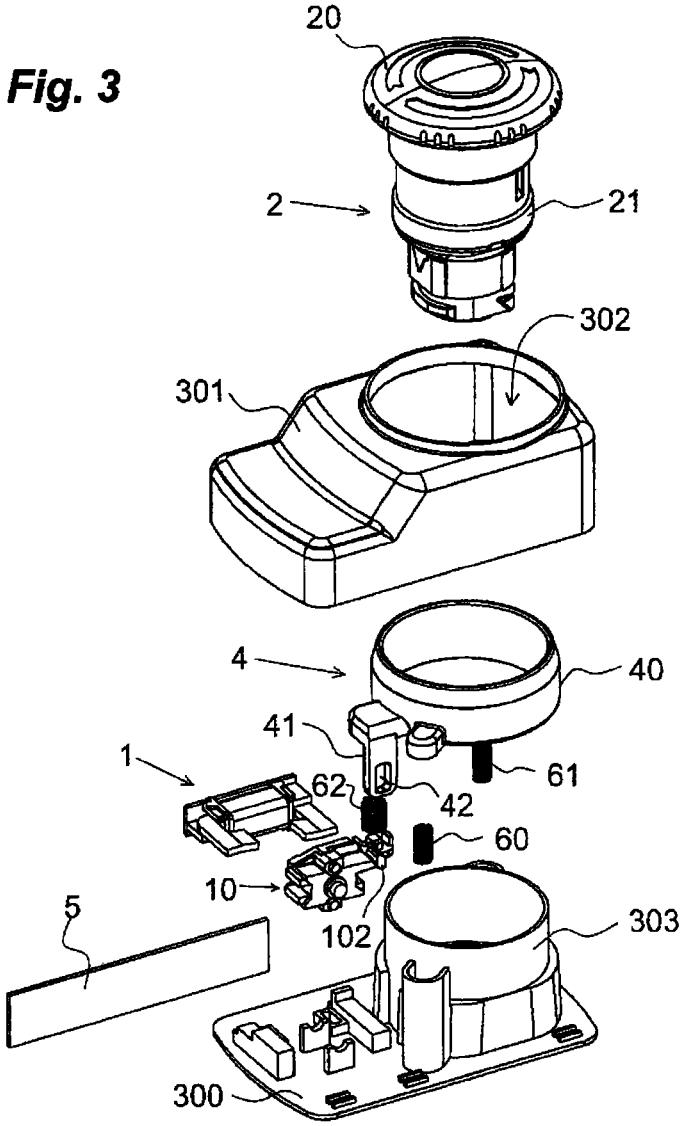
Figure 4:
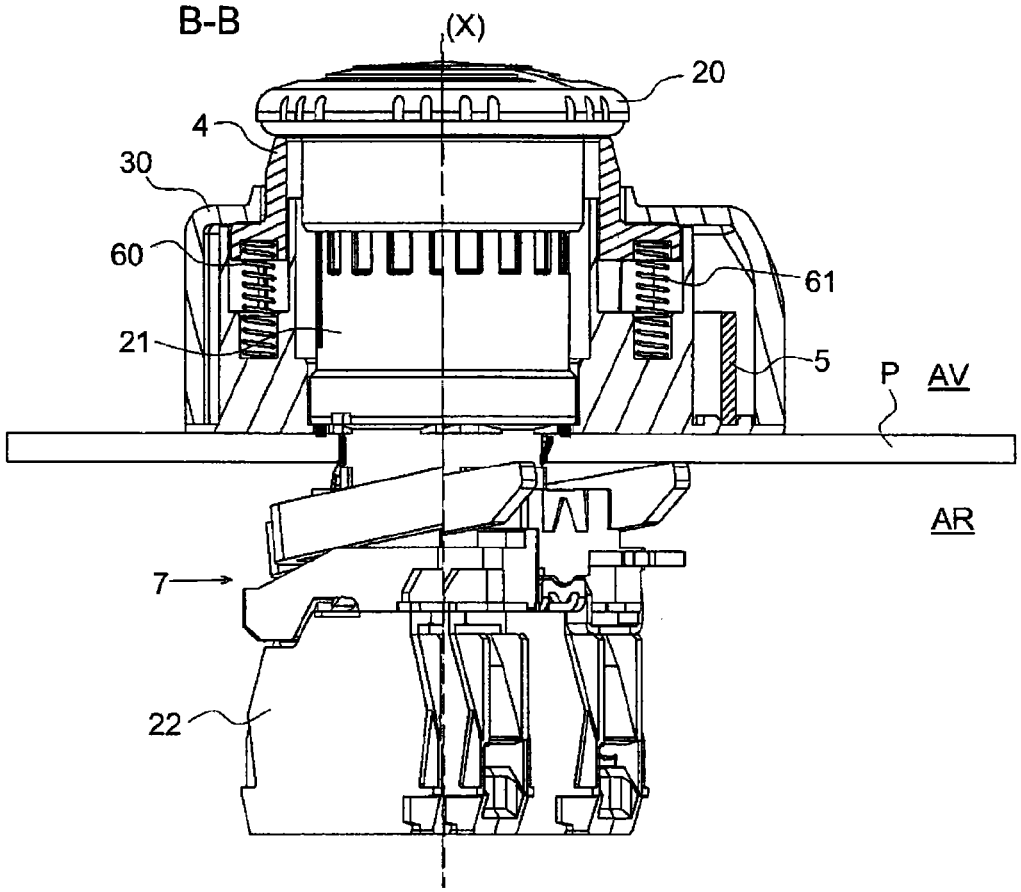
Figure 5:
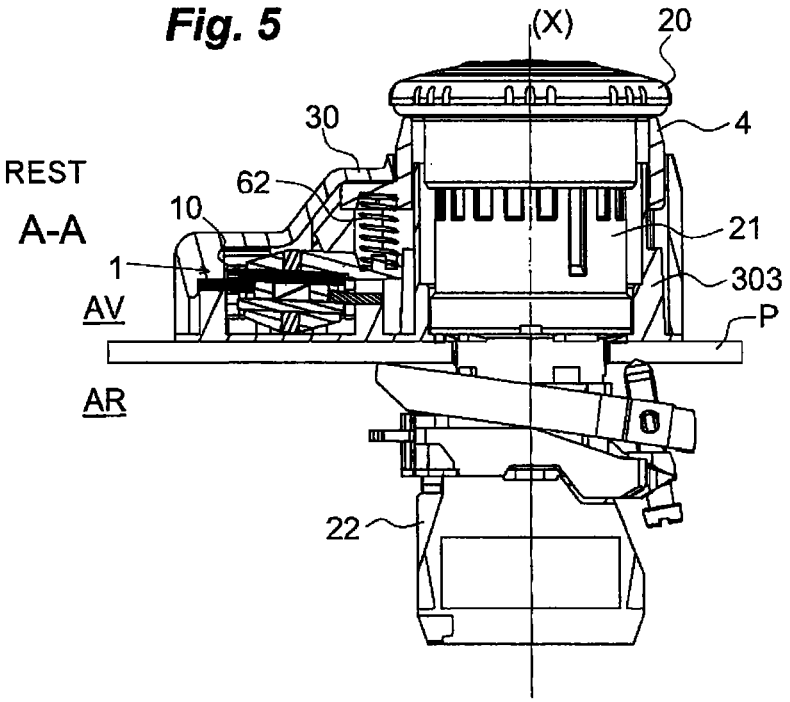
Figure 6:
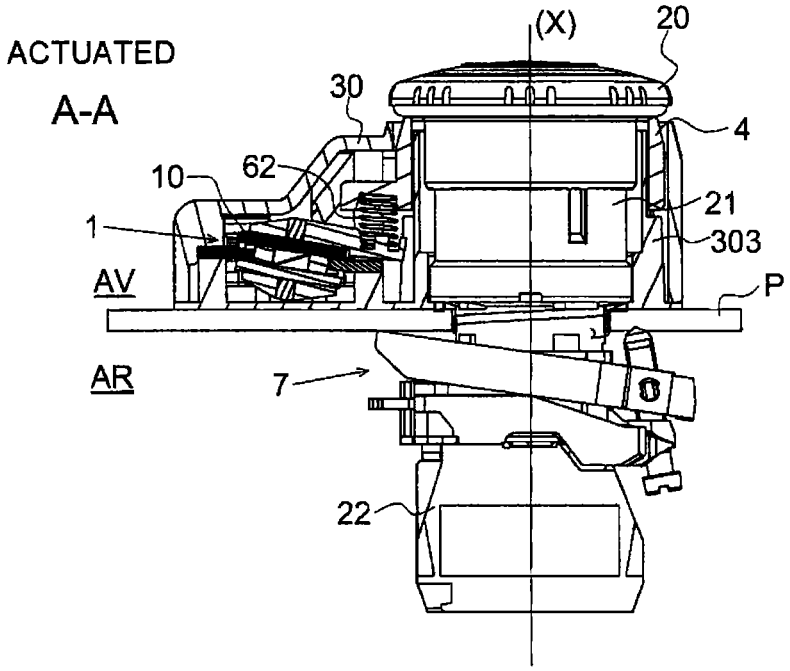
Figure 7:
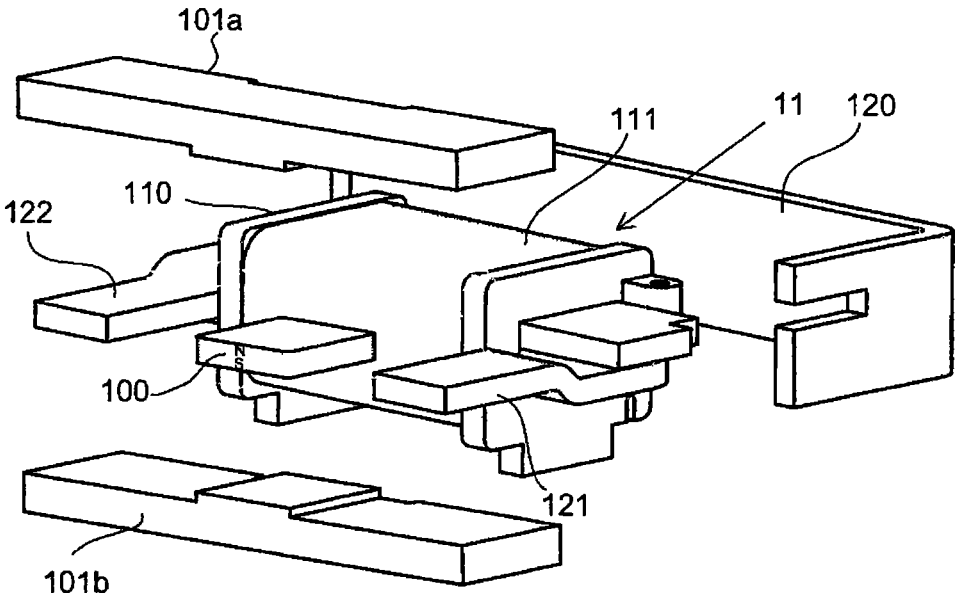
Figure 8A:
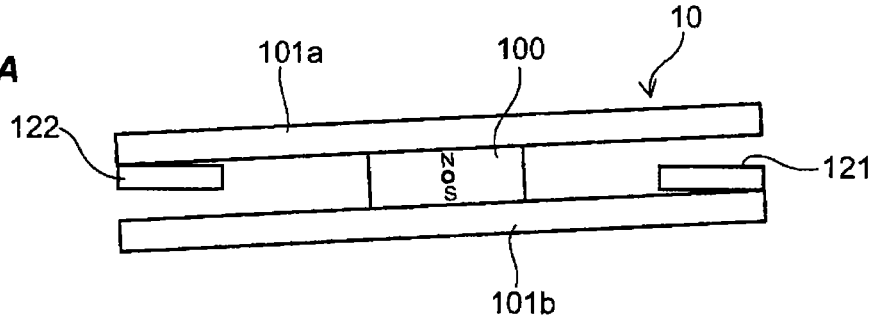
Figure 8B:
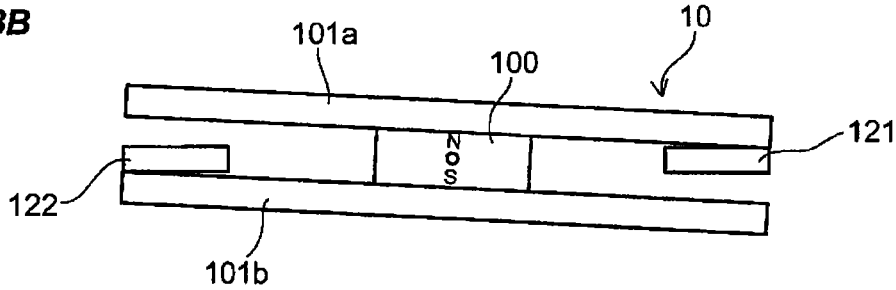

Other characteristics and advantages will become apparent from the following detailed description, referring to an embodiment given by way of example and represented by the appended drawings, in which:

FIG. 1 represents in perspective the control assembly according to the invention comprising the push-button mounted through a wall and the detection and signalling device of the invention, FIG. 2 represents the control assembly according to the invention in a view from above, FIG. 3 represents in an exploded view the detection and signalling device of the invention as well as the push-button, without its contact unit, intended to be inserted into the device of the invention, FIG. 4 represents the control assembly according to the invention in a sectional view along B-B in FIG. 2, FIGS. 5 and 6 represent the control assembly of the invention in a sectional view along A-A in FIG. 2, respectively with the control head released and the control head depressed, FIG. 7 represents the energy generator employed in the invention in an exploded view, FIGS. 8A and 8B show the two operating positions of the energy generator represented in FIG. 7.

The device of the invention makes it possible to detect the change of state of a push-button and signal this change of state by sending a message to a receiver. This device is suitable in particular for operation on a push-button, for example of the emergency stop type.

Referring to FIGS. 3 to 6, a push-button 2 of the emergency stop type has a known architecture. This architecture is principally composed of a body 21, a control head 20 mounted on the body 21, a fastening device 7 and at least one contact unit 22, for example mounted mechanically on the body 21 with the aid of the fastening device 7. A contact unit comprises, for example, mobile contacts which can be actuated by pressing on the control head 20 along a control axis (X). In order to fulfil the emergency stop function, the contacts of the contact unit are of the "normally closed" (NC) type so as to make an electrical circuit open when the control head 20 is depressed. Other contact units may also be connected up in order to fulfil other functions.

The push-button 2 is intended to be mounted axially in an orifice having a standard diameter formed through a wall P. When the push-button 2 is mounted in the orifice, the control head 20 is located on the front side (AV) with respect to the wall P and one or more contact units 22 are mounted on the rear side (AR) with respect to the wall P, which makes these units invisible to the user (FIGS. 1 to 4). The fastening device 7, which makes it possible to fix the push-button on the wall P and accommodate one or more contact units 22, is not described in detail in this application. Such a device 7 is represented in the appended figures and described in detail in the published patent EP 0,889,564, or U.S. Pat. No. 6,050,528 which corresponds to it.

The detection and signalling device 3 of the invention is in the form of an accessory or attachment which can be added to the current push-button 2 without modifying the structure of the latter. The device 3 of the invention is therefore removable, and can therefore easily be added to or removed from the push-button 2. The device 3 according to the invention has now been fitted along the control axis (X) around the body 21 of the push-button 2 so as to be positioned between the control head 20 and the wall P.

The control assembly of the invention is formed by a push-button 2, for example of the emergency stop type, and a detection and signalling device 3 as described below. These two elements, which together form the control assembly, are assembled with one another so that no structural or functional modification is necessary in order to make them work together.

Referring to FIG. 3, the detection and signalling device 3 of the invention comprises a casing 30 composed of a bottom 300 intended to bear against the wall P and a top 301 which is closed onto the bottom 300. An opening 302, through which the push-button 2 is inserted, passes fully through the casing 30, the said opening 302 being intended to be positioned coaxially with respect to the axis of the orifice passing through the wall P. The bottom 300 comprises in particular a tube 303 forming the inner wall of the opening 302.

The device comprises an electrical energy generator 1 fitted in the casing and making it possible to convert mechanical energy into electrical energy. This energy generator 1, which is described in detail below, is for example of the electromagnetic induction type or of the piezoelectric type, and makes it possible to transform mechanical energy into electrical energy, the mechanical energy being provided by the movement of a mobile mechanical control member, such as the control head 20 of the push-button.

An energy generator 1 using electromagnetic induction is represented in FIG. 7. It makes it possible to generate an electric current in an excitation coil 11 by varying the magnetic flux passing through the coil 11 by external mechanical action.

Referring to FIG. 7, the generator 1 comprises in particular the said excitation coil 11 and a magnetic circuit through which a magnetic field can flow, the said magnetic circuit being formed by a fixed part and a mobile part 10.

The magnetic flux in the magnetic circuit is defined by the instantaneous angular position of the mobile part 10 with respect to the fixed part, so that the movement of the mobile part 10 with respect to the fixed part creates a variation in the magnetic flux through the coil 11, which leads to the creation of an electric current in the coil 11. The voltage created across the terminals of the coil 11 by the variation in the magnetic flux depends on the time and therefore the rate of displacement of the mobile part 10 with respect to the fixed part.

The excitation coil 11 comprises an armature 110 made of an insulating material, on which a winding 111 of n turns of a conductive wire is wound. The armature 110 has a central opening which is formed along a longitudinal axis and whose dimensions are adapted so that the circuit can pass through it several times. In FIG. 7, the fixed part of the magnetic circuit passes through the central opening of the coil 11 twice while forming a loop. The magnetic circuit therefore passes through the central opening of the coil 11 for a first time, then passes around the coil 11 in order to form the loop, and passes through the central opening of the coil 11 for a second time.

The mobile part 10 of the magnetic circuit has for example a symmetrical H-shape, comprising for example a permanent magnet 100 sandwiched between two parallel layers 101*a*, 101*b* of ferromagnetic material, namely an upper layer 101*a* and a lower layer 101*b*. This mobile part 10 is mounted so as to rotate about a horizontal rotation axis perpendicular to the longitudinal axis of the central opening of the armature 110.

The fixed part of the magnetic circuit is made of a material with high magnetic permeability, such as a ferromagnetic material. Referring to FIG. 7, the fixed part comprises a U-shaped base 120 framing the excitation coil 11. The fixed part of the magnetic circuit also comprises a first arm 21 and a second arm 122 which are separate, not contiguous and not identical; one of the arms being the mirror image of the other. The first arm 121 is connected to the first end of the base 120, whereas the second arm 122 is connected to the second end of the base 120. These two arms 121, 122 are L-shaped and pass separately through the central opening of the armature 110 in two planes parallel to the longitudinal axis of the central opening of the coil 11. The second ends of each of the arms 121, 122 are positioned on either side of the permanent magnet 100 of the mobile part 10 and between the two ferromagnetic layers 101*a*, 101*b* of the mobile part 10. Each arm 121, 122 forms a stop for the mobile part 10 and defines two opposite bearing surfaces, namely an upper bearing surface and a lower bearing surface. The mobile part 10 has one degree of freedom in rotation between the stops formed by each of the arms 121, 122.

Since the base 120 is arranged to be positioned on either side of the coil 11, the magnetic field flowing through the arms 121, 122 always passes through the central opening of the coil 11 in the same direction. Consequently, the magnetic field passes through the central opening of the excitation coil 11 twice in the same direction.

Referring to FIGS. 8A and 8B, it can be seen that the mobile part 10 performs a seesaw movement about its axis and can occupy two different end positions defined by the stops, in each of which the mobile part 10 is held by magnetic forces. When the mobile part 10 is displaced from one of its end positions and moved beyond a central equilibrium position, it is instantaneously attracted by the magnetic force towards the other end position. This phenomenon is described particularly in the prior patent application GB 1 312 927.

According to the invention, the energy generator 1 is fitted in the casing 30 and cooperates mechanically with the control head 20 via a mobile connecting piece 4 which can be actuated in translation by the control head 20. This connecting piece 4 is fitted in the casing 30 and makes it possible to convert the movement of the control head 20 between its two positions into a movement of the mobile part 10 of the generator 1 between its two positions. Since the opening 302 formed through the device of the invention must be kept free for the push-button 2 to pass through, the energy generator is offset with respect to the control axis (X).

The device also includes at least one electronics board 5 (FIG. 3) comprising a wireless transmitter, a device for accumulating the electrical energy generated by the generator 1 and an antenna associated with the wireless transmitter. The wireless transmitter is for example of the radiofrequency type, and is supplied with the current produced by the generator 1 via the energy accumulation device. With the aid of the antenna, it makes it possible to send a message to a remote receiver (not shown) which comprises a corresponding antenna allowing it to receive the message. The wireless communication protocol used between the transmitter and the receiver will, for example, be ZIGBEE. In an alternative embodiment, the transmitter may be of the infrared type. According to the invention, the sending of a message is controlled by the movement of the control head 20. The message may comprise a plurality of identical successive frames, and will comprise in particular a unique identifier of the push-button allowing the receiver to identify the push-button which has been actuated. The receiver will comprise, for example, a table listing all the push-buttons with which it is paired and the state of each of these push-buttons.

The movement of the mobile part 10 of the generator 1 from a first position to a second position makes it possible to generate a first amount of energy in the form of a first voltage, which can be used downstream by the electronics board 5. Depending on the electronics installed on the board, it is also possible to generate a second amount of energy, in the form of a second voltage, when the mobile part 10 of the generator 1 moves from its second position to its first position. The first amount of energy and the second amount of energy, which are generated during a to-and-fro movement of the mobile part 10 of the generator 1, may each be employed by the electronics board 5 in order to send a different message. Specifically, when the mobile part 10 of the generator 1 performs a to-and-fro movement, the two voltages generated are of opposite signs, the first voltage being for example positive and the second voltage negative, which allows the electronics board to distinguish whether depression or release of the control head 20 of the push-button 2 is involved and to send two different messages, one for each of the actions.

The connecting piece 4 comprises a ring 40 formed around the axis (X) and is arranged in order to be able to slide along the axis (X) between the tube 303 formed on the bottom 300 of the casing 30 and the inner surface of the top 301 of the casing 30. The connecting piece 4 can be actuated in translation along the control axis (X) between a released position and a depressed position, and is urged in its movement by one or more springs 60, 61 (two springs in FIG. 4) bearing against the bottom 300 of the casing 30 of the device. The connecting piece 4 also comprises a tab 41 extending parallel to the control axis (X), the said tab 41 having an oblong opening 42 extending lengthwise parallel to the control axis (X). The mobile part 10 of the generator 1 cooperates mechanically with the connecting piece by means of a lug 102 passing through the oblong opening 42, the oblong opening 42 then forming a cam and the lug 102 a cam follower. The device comprises a spring 62 (FIGS. 3, 5 and 6) mounted between the tab 41 of the connecting piece 4 and the mobile part 10 of the generator 1. The connecting piece 4 therefore cooperates mechanically with the mobile part 10 of the generator 1 by means of the spring 62 and by means of the assembly formed by the lug 102 and the oblong opening 42.

The detection device of the invention, mounted on a push-button 2 of the emergency stop type, functions in the following way:

Initially, the control head 20 of the emergency stop is in the released position, that is to say at rest, and the mobile part of the energy generator is in the first position, held in this first position by the magnetic force (FIG. 5).

When the process has to be stopped in an emergency, the control head 20 of the emergency stop is depressed by the operator.

Depressing the control head 20 of the emergency stop leads not only to the process being stopped, but also to the connecting piece 4 being displaced into the casing 30 of the detection and signalling device 3. The translation of the connecting piece 4 leads to compression of the spring 62, which then stores mechanical energy. Merely the mechanical force exerted is not, however, sufficient to displace the mobile part 10 from its position. During the translation of the connecting piece 4, the oblong opening 42 slides with respect to the lug 102.

Continuing the translation, the end of the oblong opening comes in contact with the lug 102 and presses on the mobile part 10 in order to displace it from its first position. When the mobile part is displaced sufficiently, rapid rotation of the mobile part 10 into its second position is ensured by virtue of the mechanical energy stored by the spring 62.

The movement of the mobile part 10 of the generator 1 generates an amount of energy which can be used by the electronics board 5 in order to send a message to the receiver. When it receives the message, the receiver then knows the identifier of the push-button 2 which has been depressed, and can store the change of state of this push-button 2 in memory.

So long as the control head 20 of the push-button 2 is kept in the depressed position, which is often the case with an emergency stop, the mobile part 10 of the generator 1 remains in its second position.

When the control head 20 is returned into its resting position, the springs 60, 61 return the connecting piece 4 into the released position, taking with it the tab 41 of the connecting piece 4. When the oblong opening 42 again comes in contact with the lug 102 of the mobile part 10, the mobile part 10 is then displaced from its second position. Rapid rotation of the mobile part 10 into its first position is then ensured by the springs 60, 61. The amount of energy generated during the return movement can be employed to send a new message to the receiver, in order to inform it that the control head 20 has returned into the resting position. The receiver may then store the new state of the button in memory.

The invention will be used in particular to detect the change of state of push-buttons of the emergency stop type mounted in series along a process to be controlled. If the number of these emergency stops is large, the detection and signalling device 3 of the invention will make it possible to know which emergency stop has been actuated.

The invention claimed is:

1. A device for detecting and signaling a change of state of an operational push-button, the operational push-button including a body and a control head mounted on the body and actuable in translation along a principal axis between a plurality of positions so as to impart different states to the push-button to control an electrical circuit, wherein the device is in a form of an add-on that can be retrofitted to the operational push-button and comprises:

a casing having an outer wall through which an opening is formed, the body of the operational push-button configured to pass through the opening when the device is retrofitted to the push button;

an electrical energy generator housed in the casing between the outer wall and the opening such that the electrical energy generator cooperates with the control head to convert mechanical energy into electrical energy to detect a change of state of the operational push-button; and a wireless transmitter to send a message to a remote receiver, the wireless transmitter being housed in the casing between the outer wall and the opening, and electrically connected to the electrical energy generator such that the wireless transmitter signals said change of state of the operational push button.

2. A device according to claim 1, wherein the electrical energy generator is of electromagnetic type and comprises a magnetic circuit including a fixed part and a mobile part and an electromagnetic coil through which the magnetic circuit passes.

3. A device according to claim 2, wherein a connecting piece cooperates with the electrical energy generator and is actuable in translation by the control head.

4. A device according to claim 3, wherein the connecting piece comprises a ring mounted on return spring means, coaxially with respect to the opening.

5. A device according to claim 4, wherein a spring is mounted between the connecting piece and the mobile part of the electrical energy generator.

6. A device according to claim 5, wherein the connecting piece comprises a tab integral with the ring, the tab including an oblong opening through which a lug formed on the mobile part passes.

7. A device according to claim 2, wherein the mobile part of the electrical energy generator can move between a first position and a second position, and the energy generator is configured to generate a first amount of energy when the mobile part passes from the first position to the second position and a second amount of energy when the mobile part passes from the second position to the first position.

8. A device according to claim 1, further comprising an electronics board housed in the casing and comprising the wireless transmitter, the wireless transmitter being electrically connected to the electrical energy generator.

9. A device according to claim 1, wherein the transmitter is a radiofrequency transmitter.

10. A device according to claim 1, wherein the transmitter is of infrared type.

11. A control assembly comprising:

a push-button including a body, and a control head mounted on the body and actuable in translation along a principal axis between a plurality of positions so as to impart different states to the push-button;

a device for detecting and signaling change of state of the push-button as defined in claim 1, the device being fitted around the push-button and configured to cooperate mechanically with the control head.

12. A control assembly according to claim 11, wherein the wireless transmitter is configured to send a first message when the control head of the push-button is depressed and a second message when the control head of the push-button is released.

13. A control assembly according to claim 1, wherein:

the control assembly comprises a contact unit assembled on the body of the push-button and configured to be actuated by the control head;

the body of the push-button is mounted in an orifice formed through a wall, the control head being located on a front side with respect to the wall and the contact unit on a rear side with respect to the wall;

the device for detecting the change of state of the push-button is mounted on the front side with respect to the wall and arranged between the control head and the wall.

14. A control assembly according to claim 11, wherein the push-button is of emergency stop type.

* * * * *